US010669506B2

(12) United States Patent
Boons

(10) Patent No.: US 10,669,506 B2
(45) **Date of Patent: *Jun. 2, 2020**

(54) MARINE DIESEL CYLINDER LUBRICANT OIL COMPOSITIONS

(71) Applicant: Chevron Oronite Technology B.V., Rotterdam (NL)

(72) Inventor: Cornelis H. M. Boons, Prinsenbeek (NL)

(73) Assignee: Chevron Oronite Technology B.V., Rotterdam (NL)

( * ) Notice: Subject to any disclaimer, the term of this patent is extended or adjusted under 35 U.S.C. 154(b) by 427 days.

This patent is subject to a terminal disclaimer.

(21) Appl. No.: 14/534,444

(22) Filed: Nov. 6, 2014

(65) Prior Publication Data

US 2015/0126422 A1 May 7, 2015

Related U.S. Application Data

(60) Provisional application No. 61/900,678, filed on Nov. 6, 2013.

(51) Int. Cl.
*C10M 141/08* (2006.01)
*C10M 169/04* (2006.01)

(52) U.S. Cl.
CPC ..... *C10M 141/08* (2013.01); *C10M 169/042* (2013.01); *C10M 2203/1025* (2013.01); *C10M 2207/144* (2013.01); *C10M 2207/262* (2013.01); *C10M 2215/28* (2013.01); *C10M 2219/046* (2013.01); *C10M 2219/089* (2013.01); *C10N 2230/02* (2013.01); *C10N 2230/04* (2013.01); *C10N 2230/08* (2013.01); *C10N 2230/10* (2013.01); *C10N 2230/52* (2013.01); *C10N 2240/102* (2013.01)

(58) Field of Classification Search
CPC ..... C10M 2207/262; C10M 2219/046
USPC ..... 508/391
See application file for complete search history.

(56) References Cited

U.S. PATENT DOCUMENTS

| | | | |
|---|---|---|---|
| 3,036,003 | A | 5/1962 | Verdol |
| 3,172,892 | A | 3/1965 | LeSuer et al. |
| 3,219,666 | A | 11/1965 | Norman et al. |
| 3,272,746 | A | 9/1966 | LeSuer et al. |
| 3,275,554 | A | 9/1966 | Wagennar |
| 3,329,658 | A | 7/1967 | Fields |
| 3,438,757 | A | 4/1969 | Honnen et al. |
| 3,449,250 | A | 6/1969 | Fields |
| 3,454,555 | A | 7/1969 | Van Der Voort et al. |
| 3,565,804 | A | 2/1971 | Honnen et al. |
| 3,586,629 | A | 6/1971 | Otto et al. |
| 3,591,598 | A | 7/1971 | Traise et al. |
| 3,666,730 | A | 5/1972 | Coleman |
| 3,980,569 | A | 9/1976 | Pindar et al. |
| 4,234,435 | A | 11/1980 | Meinhardt et al. |
| 4,612,132 | A | 9/1986 | Wollenberg et al. |
| 4,746,446 | A | 5/1988 | Wollenberg et al. |
| 4,943,672 | A | 7/1990 | Hamner et al. |
| 5,059,299 | A | 10/1991 | Cody et al. |
| 5,716,912 | A | 2/1998 | Harrison et al. |
| 5,733,839 | A | 3/1998 | Espinoza et al. |
| 6,162,770 | A | 12/2000 | LeCoent et al. |
| 6,165,235 | A | 12/2000 | Kolp et al. |
| 6,191,081 | B1 | 2/2001 | Cartwright et al. |
| 6,372,696 | B1 | 4/2002 | Tipton |
| 6,440,905 | B1 | 8/2002 | Epps et al. |
| 6,479,440 | B1 * | 11/2002 | Le Coent ..... C10M 159/24 508/391 |
| 6,596,673 | B1 * | 7/2003 | Bovington ..... C10M 163/00 508/436 |
| 7,018,525 | B2 | 3/2006 | Miller et al. |
| RE39,073 | E | 4/2006 | Herbolzheimer et al. |
| 7,083,713 | B2 | 8/2006 | Abernathy et al. |
| 7,183,452 | B2 | 2/2007 | Campbell et al. |
| 2002/0082176 | A1 | 6/2002 | Chambard et al. |
| 2004/0159582 | A1 | 8/2004 | Simmons et al. |
| 2004/0235686 | A1 | 11/2004 | Boons et al. |
| 2005/0003972 | A1 | 1/2005 | Chambard et al. |
| 2005/0077208 | A1 | 4/2005 | Miller et al. |
| 2005/0133407 | A1 | 6/2005 | Abernathy et al. |
| 2005/0133409 | A1 | 6/2005 | Abernathy et al. |
| 2005/0139513 | A1 | 6/2005 | Miller |

(Continued)

FOREIGN PATENT DOCUMENTS

| | | | |
|---|---|---|---|
| EP | 668342 | B1 | 8/1999 |
| EP | 1016706 | A2 | 7/2000 |
| EP | 1 126 010 | A1 | 8/2001 |
| EP | 776959 | A | 10/2004 |
| EP | 1 486 556 | A1 | 12/2004 |
| EP | 1486556 | A1 | 12/2004 |
| JP | 11080771 | A | 9/1997 |
| WO | 9920720 | A1 | 4/1999 |
| WO | 9934917 | A1 | 7/1999 |
| WO | 05107935 | A1 | 11/2005 |

OTHER PUBLICATIONS

"Calcium Alkyl Salicylate T109", Jan. 26, 2010, XP055162299.

*Primary Examiner* — Vishal V Vasisth

(74) *Attorney, Agent, or Firm* — Ryan, Mason & Lewis, LLP

(57) ABSTRACT

Disclosed herein are marine diesel cylinder lubricating oil compositions which comprises (a) a major amount of one or more Group II basestocks, and (b) a detergent composition comprising (i) one or more alkaline earth metal salts of an alkyl-substituted hydroxyaromatic carboxylic acid having a TBN of about 100 to about 250, and (ii) one or more high overbased alkyl aromatic sulfonic acids or salts thereof; wherein the aromatic moiety of the alkyl aromatic sulfonic acids or salts thereof contains no hydroxyl groups; and wherein the marine diesel cylinder lubricating oil composition has a TBN of about 5 to about 120.

20 Claims, No Drawings

(56) References Cited

U.S. PATENT DOCUMENTS

| | | | | |
|---|---|---|---|---|
| 2005/0139514 | A1 | 6/2005 | Miller | |
| 2005/0153847 | A1 | 7/2005 | Chambard et al. | |
| 2005/0227866 | A1 | 10/2005 | Berge et al. | |
| 2005/0241990 | A1 | 11/2005 | Ziemer et al. | |
| 2005/0261145 | A1 | 11/2005 | Rosenbaum et al. | |
| 2005/0261146 | A1 | 11/2005 | Rosenbaum et al. | |
| 2005/0261147 | A1 | 11/2005 | Rosenbaum et al. | |
| 2006/0013210 | A1 | 1/2006 | Bordogna et al. | |
| 2006/0016721 | A1 | 1/2006 | Miller et al. | |
| 2006/0016724 | A1 | 1/2006 | Miller et al. | |
| 2006/0020185 | A1 | 1/2006 | Al-Ali | |
| 2006/0063686 | A1 | 3/2006 | Yagishita | |
| 2006/0076267 | A1 | 4/2006 | Miller | |
| 2006/0201851 | A1 | 9/2006 | Rosenbaum et al. | |
| 2006/0229216 | A1 | 10/2006 | Dowding et al. | |
| 2006/0289337 | A1 | 12/2006 | Rosenbaum et al. | |
| 2007/0027043 | A1 | 2/2007 | LeCoent | |
| 2007/0238628 | A1 | 10/2007 | Haire et al. | |
| 2008/0153721 | A1 | 6/2008 | Rosenbaum et al. | |
| 2008/0153723 | A1* | 6/2008 | Boons | C10M 163/00 508/150 |
| 2009/0156440 | A1* | 6/2009 | Verlinde | C10M 133/56 508/229 |
| 2010/0062957 | A1* | 3/2010 | Bertram | C10M 159/22 508/460 |
| 2011/0077182 | A1* | 3/2011 | Jukes | C10M 129/54 508/460 |
| 2011/0195882 | A1 | 8/2011 | Carey et al. | |

* cited by examiner

MARINE DIESEL CYLINDER LUBRICANT OIL COMPOSITIONS

PRIORITY

This application claims the benefit under 35 U.S.C. § 119 to Provisional Application Ser. No. 61/900,678, filed on Nov. 6, 2013, the contents of which are incorporated by reference herein.

BACKGROUND OF THE INVENTION

1. Technical Field

The present invention generally relates to a marine diesel cylinder lubricating oil composition, in particular, for lubricating a marine two-stroke crosshead diesel cylinder engine.

2. Description of the Related Art

In the not so distant past, rapidly escalating energy costs, particularly those incurred in distilling crude oil and liquid petroleum, became burdensome to the users of transportation fuels, such as owners and operators of seagoing ships. In response, those users have steered their operations away from steam turbine propulsion units in favor of large marine diesel engines that are more fuel efficient. Diesel engines may generally be classified as low-speed, medium-speed, or high-speed engines, with the low-speed variety being used for the largest, deep shaft marine vessels and certain other industrial applications.

Low-speed diesel engines are unique in size and method of operation. The engines themselves are massive, the larger units may approach 200 tons in weight and upward of 10 feet in length and 45 feet in height. The output of these engines can reach as high as 100,000 brake horsepower with engine revolutions of 60 to about 200 revolutions per minute. They are typically of crosshead design and operate on the two-stroke cycle. In addition, these engines usually operate on residual fuels, but some may also operate on distillate fuels that contain little or no residue.

Medium-speed engines, on the other hand, typically operate in the range of about 250 to about 1100 rpm and may operate on either the four-stroke or the two-stroke cycle. These engines can be of trunk piston design or occasionally of crosshead design. They usually operate on residual fuels, just like the low-speed diesel engines, but some may also operate on distillate fuels that contain little or no residue. These engines can also be used for propulsion, ancillary applications or both on deep-sea vessels.

Low- and medium-speed diesel engines are also extensively used in power plant operations. A low- or medium-speed diesel engine that operates on the two-stroke cycle is typically a direct-coupled and direct-reversing engine of crosshead construction. with a diaphragm and one or more stuffing boxes separating the power cylinders from the crankcase to prevent combustion products from entering the crankcase and mixing with the crankcase oil. The notable complete separation of the crankcase from the combustion zone has led persons skilled in the art to lubricate the combustion chamber and the crankcase with different lubricating oils.

In large diesel engines of the crosshead type used in marine and heavy stationary applications, the cylinders are lubricated separately from the other engine components. The cylinders are lubricated on a total loss basis with the cylinder oil being injected separately to quills on each cylinder by means of lubricators positioned around the cylinder liner. Oil is distributed to the lubricators by means of pumps, which are, in modern engine designs, actuated to apply the oil directly onto the rings to reduce wastage of the oil.

One problem associated with these engines is that their manufacturers commonly design them to use a variety of diesel fuels, ranging from good quality high distillate fuel with low sulfur and low asphaltene content to poorer quality intermediate or heavy fuel such as marine residual fuel with generally high sulfur and higher asphaltene content.

The high stresses encountered in these engines and the use of marine residual fuels creates the need for lubricants with a high detergency and neutralizing capability even though the oils are exposed to thermal and other stresses only for short periods of time. Residual fuels commonly used in these diesel engines typically contain significant quantities of sulfur, which, in the combustion process, combine with water to form sulfuric acid, the presence of which leads to corrosive wear. In particular, in two-stroke engines for ships, areas around the cylinder liners and piston rings can be corroded and worn by the acid. Therefore, it is important for diesel engine lubricating oils to have the ability to resist such corrosion and wear.

Accordingly, a primary function of marine diesel cylinder lubricants is to neutralize sulfur-based acidic components of high-sulfur fuel oil combusted in low-speed 2-stroke cross-head diesel engines. This neutralization is accomplished by the inclusion in the marine diesel cylinder lubricant of basic species such as metallic detergents. Unfortunately the basicity of the marine diesel cylinder lubricant can be diminished by oxidation of the marine diesel cylinder lubricant (caused by the thermal and oxidative stress the lubricant undergoes in the engine), thus decreasing the lubricant's neutralization ability. The oxidation can be accelerated if the marine diesel cylinder lubricants contain oxidation catalysts such as wear metals that are generally known to be present in the lubricant during engine operation.

Marine two-stroke diesel cylinder lubricants must meet performance demands in order to comply with the severe operating conditions required for more modern larger bore, two-stroke cross-head diesel marine engines which are run at high outputs and severe loads and higher temperatures of the cylinder liner.

Presently, the marine industry has been dealing with challenges of a growing shortage of Group I category basestocks, typically used for marine engine oils, as well as lower sulfur fuel levels forced by legislation. In addition to these challenges, marine two-stroke diesel cylinder lubricants must meet performance demands in order to comply with the severe operating conditions required for more modern larger bore, two-stroke cross-head diesel marine engines which are run at high outputs and severe loads and higher temperatures of the cylinder liner. Therefore, there is a further need for marine cylinder lubricating oil compositions which are compatible with basestocks other than Group I basestocks while having improved detergency and high heat stability at high temperatures to comply with the severe load conditions of the large bore two-stroke engines operating on fuels with a wide range of sulfur.

Recently, generic design changes in large bore, low-speed, two-stroke engines as well as changes in operations (both driven by fuel efficiency) have contributed to the frequent occurrence of severe cold corrosion. Cold corrosion is caused by sulfuric acid. The sulfur oxides that result from combustion of the fuel (typically a Heavy Fuel Oil with >2 wt % sulfur) will, with the water formed during combustion and the water from the scavenge air, form sulfuric acid. When the liner temperature drops below the dew point of sulfuric acid and water, a corrosive mixture is condensed on the liner. Cylinder lubricant basicity, cylinder lubricant feed rate of the oil to the cylinder liner, engine make and type, engine load, inlet air humidity and fuel sulfur content are among the factors that can influence the amount of cold corrosion. High alkaline lubricants are used to neutralize the sulfuric acids and avoid cold corrosion of piston rings and cylinder liner surfaces. High alkalinity lubricants (e.g., up to 100 BN by the ASTM D2896 test method) are currently being marketed to help overcome severe cold corrosion.

Sulfurized, overbased phenates are known compounds which are widely used in marine applications for their detergency properties and thermal stability. However, low molecular weight alkylphenol compounds such as tetrapropenyl phenol (TPP) are often used as raw materials in the manufacture of these sulfurized, overbased phenates. The process to manufacture overbased phenates generally results in the presence of the unreacted alkylphenol in the final reaction product and ultimately in the finished lubricating oil composition. Recent reproductive toxicity studies have shown that in high concentrations of unreacted alkylphenol, TPP in particular, may be endocrine disruptive materials which can cause adverse effects in male and female reproductive organs.

To reduce any potential health risks to customers and avoid potential regulatory issues, there is a further need to reduce or eliminate the amount of unreacted TPP and its unsulfurized metal salt present in lubricating oil compositions. Therefore, it would be even more desirable to develop a marine diesel cylinder lubricating oil composition that is substantially free of unreacted TPP and its unsulfurized metal salt.

SUMMARY OF THE INVENTION

In accordance with one embodiment of the present invention, a marine diesel cylinder engine lubricating oil composition is provided which comprises (a) a major amount of one or more Group II basestocks, and (b) a detergent composition comprising (i) one or more alkaline earth metal salts of an alkyl-substituted hydroxyaromatic carboxylic acid having a total base number (TBN) of about 100 to about 250, and (ii) one or more high overbased alkyl aromatic sulfonic acids or salts thereof; wherein the aromatic moiety of the alkyl aromatic sulfonic acids or salts contains no hydroxyl groups; and wherein the marine diesel cylinder lubricating oil composition has a TBN of about 5 to about 120.

In accordance with a second embodiment of the present invention, there is provided a method for lubricating a marine two-stroke crosshead diesel engine with a marine diesel cylinder lubricant composition having improved high temperature detergency and thermal stability; wherein the method comprises operating the engine with a marine diesel cylinder lubricating oil composition comprising (a) a major amount of one or more Group II basestocks, and (b) a detergent composition comprising (i) one or more alkaline earth metal salts of an alkyl-substituted hydroxyaromatic carboxylic acid having a TBN of about 100 to about 250, and (ii) one or more high overbased alkyl aromatic sulfonic acids or salts thereof; wherein the aromatic moiety of the alkyl aromatic sulfonic acids or salts thereof contains no hydroxyl groups; and wherein the marine diesel cylinder lubricating oil composition has a TBN of about 5 to about 120.

A third embodiment of the present invention is directed to a use of a marine diesel cylinder lubricating oil composition in a two-stroke crosshead marine diesel engine; wherein the marine diesel cylinder lubricant composition comprises (a) a major amount of one or more Group II basestocks, and (b) a detergent composition comprising (i) one or more alkaline earth metal salts of an alkyl-substituted hydroxyaromatic carboxylic acid having a TBN of about 100 to about 250, and (ii) one or more high overbased alkyl aromatic sulfonic acids or salts thereof; wherein the aromatic moiety of the alkyl aromatic sulfonic acids or salts thereof contains no hydroxyl groups; and wherein the marine diesel cylinder lubricating oil composition has a TBN of about 5 to about 120, to provide a marine diesel cylinder lubricating oil composition having improved high temperature detergency and thermal stability.

The present invention is based on the surprising discovery that the combination of one or more alkaline earth metal salts of an alkyl-substituted hydroxyaromatic carboxylic acid having a TBN of about 100 to about 250, and one or more high overbased alkyl aromatic sulfonic acids or salts thereof advantageously improves the high temperature detergency and thermal stability of a marine diesel cylinder lubricating oil composition used in a two-stroke crosshead marine diesel engine; wherein the marine diesel cylinder lubricant has a TBN of from about 5 to about 120 and contains a major amount of one or more Group II basestocks. In addition, the combination of one or more alkaline earth metal salts of an alkyl-substituted hydroxyaromatic carboxylic acid having a TBN of about 100 to about 250, and one or more high overbased alkyl aromatic sulfonic acids or salts thereof also advantageously improves the storage stability of a marine diesel cylinder lubricating oil composition having a TBN of from about 5 to about 120 and containing a major amount of one or more Group II basestocks.

DETAILED DESCRIPTION OF THE PREFERRED EMBODIMENTS

Definitions

The term "marine diesel cylinder lubricant" or "marine diesel cylinder lubricating oil" as used herein shall be understood to mean a lubricant used in the cylinder lubrication of a low speed or medium speed two-stroke crosshead marine diesel engine. The marine diesel cylinder lubricant is fed to the cylinder walls through a number of injection points. Marine diesel cylinder lubricants are capable of providing a film between the cylinder liner and the piston rings and holding partially burned fuel residues in suspension, to thereby promote engine cleanliness and neutralize acids formed by, for example, the combustion of sulfur compounds in the fuel.

A "marine residual fuel" refers to a material combustible in large marine engines which has a carbon residue, as defined in International Organization for Standardization (ISO) 10370) of at least 2.5 wt. % (e.g., at least 5 wt. %, or at least 8 wt. %) (relative to the total weight of the fuel), a viscosity at 50° C. of greater than 14.0 cSt, such as the marine residual fuels defined in the International Organization for Standardization specification ISO 8217:2005, "Petroleum products—Fuels (class F)—Specifications of marine fuels," the contents of which are incorporated herein in their entirety.

A "residual fuel" refers to a fuel meeting the specification of a residual marine fuel as set forth in the ISO 8217:2010 international standard. A "low sulfur marine fuel" refers to a fuel meeting the specification of a residual marine fuel as set forth in the ISO 8217:2010 specification that, in addition, has about 1.5 wt. % or less, or even about 0.5% wt. % or less, of sulfur, relative to the total weight of the fuel.

A "distillate fuel" refers to a fuel meeting the specification of a distillate marine fuel as set forth in the ISO 8217:2010 international standard. A "low sulfur distillate fuel" refers to a fuel meeting the specification of a distillate marine fuel set forth in the ISO 8217:2010 international standard that, in addition, has about 0.1 wt. % or less or even about 0.005 wt. % or less, of sulfur, relative to the total weight of the fuel.

The term "bright stock", as used by persons skilled in the art, refers to base oils that are direct products of de-asphalted petroleum vacuum residuum or derived from de-asphalted petroleum vacuum residuum after further processing such as solvent extraction and/or dewaxing. For the purposes of this invention, it also refers to deasphalted distillate cuts of a vacuum residuum process. Bright stocks generally have a kinematic viscosity at 100° C. of from 28 to 36 $mm^2/s$. One example of such a bright stock is ESSO™ Core 2500 Base Oil.

The term "Group II metal" or "alkaline earth metal" means calcium, barium, magnesium, and strontium.

The term "calcium base" refers to a calcium hydroxide, calcium oxide, calcium alkoxide and the like and mixtures thereof.

The term "lime" refers to calcium hydroxide also known as slaked lime or hydrated lime.

The term "alkylphenol" refers to a phenol group having one or more alkyl substituents at least one of which has a sufficient number of carbon atoms to impart oil solubility to the resulting phenate additive.

The term "Total Base Number" or "TBN" refers to the level of alkalinity in an oil sample, which indicates the ability of the composition to continue to neutralize corrosive acids, in accordance with ASTM Standard No. D2896 or equivalent procedure. The test measures the change in electrical conductivity, and the results are expressed as mgKOH/g (the equivalent number of milligrams of KOH needed to neutralize 1 gram of a product). Therefore, a high TBN reflects strongly overbased products and, as a result, a higher base reserve for neutralizing acids.

The term "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both.

The term "on an actives basis" refers to additive material that is not diluent oil or solvent.

In one embodiment, a marine diesel cylinder lubricating oil composition is provided which comprises (a) a major amount of one or more Group II basestocks, and (b) a detergent composition comprising (i) one or more alkaline earth metal salts of an alkyl-substituted hydroxyaromatic carboxylic acid having a TBN of about 100 to about 250, and (ii) one or more high overbased alkyl aromatic sulfonic acids or salts thereof; wherein the aromatic moiety of the alkyl aromatic sulfonic acids or salts thereof contains no hydroxyl groups; and wherein the marine diesel cylinder lubricating oil composition has a TBN of about 5 to about 120.

In general, the marine diesel cylinder lubricating oil compositions of this invention will have a TBN of from about 5 to about 120. In one embodiment, the marine diesel cylinder lubricating oil compositions of this invention can have a TBN of from about 20 to about 100. In one embodiment, the marine diesel cylinder lubricating oil compositions of this invention can have a TBN of from about 20 to about 60. In one embodiment, the marine diesel cylinder lubricating oil compositions of this invention can have a TBN of from about 30 to about 50.

Due to low-operating speeds and high loads in marine engines, high viscosity oils (e.g., SAE 40, 50, and 60) are typically required. The marine diesel cylinder lubricating oil compositions of this invention can have a kinematic viscosity ranging from about 12.5 to about 26.1 centistokes (cSt) at 100° C. In another embodiment, the lubricating oil composition has a viscosity of about 12.5 to about 21.9, or about 16.3 to about 21.9 cSt at 100° C. The kinematic viscosity of the marine diesel cylinder lubricating oil compositions is measured by ASTM D445.

The marine diesel cylinder lubricating oil compositions of the present invention can be prepared by any method known to a person of ordinary skill in the art for making marine diesel cylinder lubricating oil compositions. The ingredients can be added in any order and in any manner. Any suitable mixing or dispersing equipment may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., a Gaulin homogenizer or Rannie homogenizer), a mill (e.g., colloid mill, ball mill or sand mill) or any other mixing or dispersing equipment known in the art.

The Group II basestocks for use herein can be any petroleum derived base oil of lubricating viscosity as defined in API Publication 1509, 14th Edition, Addendum I, December 1998. API guidelines define a base stock as a lubricant component that may be manufactured using a variety of different processes. A Group II basestock generally refers to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270).

In one embodiment, the one or more Group II basestocks can be a blend or mixture of two or more, three or more, or even four or more Group II basestocks having different molecular weights and viscosities, wherein the blend is processed in any suitable manner to create a base oil having suitable properties (such as the viscosity and TBN values, discussed above) for use in a marine diesel engine.

The one or more Group II basestocks for use in the marine diesel engine lubricating oil compositions of this invention are typically present in a major amount, e.g., an amount greater than about 50 wt. %, or greater than about 70 wt. %, based on the total weight of the composition. In one embodiment, the one or more Group II basestocks are present in an amount of from 70 wt. % to about 95 wt. %, based on the total weight of the composition. In one embodiment, the one or more Group II basestocks are present in an amount of from 70 wt. % to about 85 wt. %, based on the total weight of the composition.

If desired, the marine diesel engine lubricating oil compositions of the present invention can contain minor amounts of basestocks other than a Group II basestock. For example, the marine diesel engine lubricating oil compositions can contain minor amounts of Groups I or III-V basestocks as defined in API Publication 1509, $16^{th}$ Edition, Addendum I, October, 2009. Group IV base oils are polyalphaolefins (PAO).

As stated above, the marine diesel cylinder lubricating oil compositions for use in marine diesel engines typically have a kinematic viscosity in the range of 12.5 to 26.1 cSt at 100° C. In order to formulate such a lubricant, a bright stock may be combined with a low viscosity oil, e.g., an oil having a viscosity from 4 to 6 cSt at 100° C. However, supplies of bright stock are dwindling and therefore bright stock cannot be relied upon to increase the viscosity of marine cylinder lubricants to the desired ranges that manufacturers recommend. One solution to this problem is to use thickeners such as, for example, polyisobutylene (PIB) or viscosity index improver compounds such as olefin copolymers to thicken the marine diesel cylinder lubricating oil compositions. PIB is a commercially available material from several manufacturers. The PIB is typically a viscous oil-miscible liquid, having a weight average molecular weight in the range of about 1,000 to about 8,000, or from about 1,500 to about 6,000, and a viscosity in the range of about 2,000 to about 5,000 or about 6,000 cSt (at 100° C.). The amount of PIB added to the marine diesel cylinder lubricating oil compositions will normally be from about 1 to about 20 wt. % of the finished oil, or from about 2 to about 15 wt. % of the finished oil, or from about 4 to about 12 wt. % of the finished oil.

Group I base oils generally refer to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

Group I base oils can comprise light overhead cuts and heavier side cuts from a vacuum distillation column and can also include, for example, Light Neutral, Medium Neutral, and Heavy Neutral base stocks. The petroleum derived base oil also may include residual stocks or bottoms fractions, such as, for example, bright stock. Bright stock is a high viscosity base oil which has been conventionally produced from residual stocks or bottoms and has been highly refined and dewaxed. Bright stock can have a kinematic viscosity greater than about 180 cSt at 40° C., or even greater than about 250 cSt at 40° C., or even ranging from about 500 to about 1100 cSt at 40° C. In one embodiment, a Group I basestock comprises ExxonMobil CORE® 100, ExxonMobil CORES® 150, ExxonMobil CORE® 600, or ExxonMobil CORE® 2500, or mixture thereof.

A Group III basestock generally has a total sulfur content less than or equal to 0.03 wt. % (as determined by ASTM D 2270), a saturates content of greater than or equal to 90 wt. % (as determined by ASTM D 2007), and a viscosity index (VI) of greater than or equal to 120 (as determined by ASTM D 4294, ASTM D 4297 or ASTM D 3120). In one embodiment, the basestock is a Group III basestock, or a blend of two or more different Group III basestocks.

In general, Group III basestocks derived from petroleum oils are severely hydrotreated mineral oils. Hydrotreating involves reacting hydrogen with the basestock to be treated to remove heteroatoms from the hydrocarbon, reduce olefins and aromatics to alkanes and cycloparaffins respectively, and in very severe hydrotreating, open up naphthenic ring structures to non-cyclic normal and iso-alkanes ("paraffins"). In one embodiment, a Group III basestock has a paraffinic carbon content (% $C_p$) of at least about 70%, as determined by test method ASTM D 3238-95 (2005). "Standard Test Method for Calculation of Carbon Distribution and Structural Group Analysis of Petroleum Oils by the n-d-M Method". In another embodiment, a Group III basestock has a paraffinic carbon content (% $C_p$) of at least about 72%. In another embodiment, a Group III basestock has a paraffinic carbon content (% $C_p$) of at least about 75%. In another embodiment, a Group III basestock has a paraffinic carbon content (% $C_p$) of at least about 78%. In another embodiment, a Group III basestock has a paraffinic carbon content (% $C_p$) of at least about 80%. In another embodiment, a Group III basestock has a paraffinic carbon content (% $C_p$) of at least about 85%.

In another embodiment, a Group III basestock has a naphthenic carbon content (% $C_n$) of no more than about 25%, as determined by ASTM D 3238-95 (2005). In another embodiment, a Group III basestock has a naphthenic carbon content (% $C_n$) of no more than about 20%. In another embodiment, a Group III basestock has a naphthenic carbon content (% $C_n$) of no more than about 15%. In another embodiment, a Group III basestock has a naphthenic carbon content (% $C_n$) of no more than about 10%.

Many of the Group III basestocks are available commercially, e.g., Chevron UCBO basestocks; Yukong Yubase basestocks; Shell XHVI® basestocks; and ExxonMobil Exxsyn® basestocks.

In one embodiment, a Group III basestock for use herein is a Fischer-Tropsch derived base oil. The term "Fischer-Tropsch derived" means that the product, fraction, or feed originates from or is produced at some stage by a Fischer-Tropsch process. For example, a Fischer Tropsch base oil can be produced from a process in which the feed is a waxy feed recovered from a Fischer-Tropsch synthesis, see, e.g., U.S. Patent Application Publication Nos. 2004/0159582; 2005/0077208; 2005/0133407; 2005/0133409; 2005/0139513; 2005/0139514; 2005/0241990; 2005/0261145; 2005/0261146; 2005/0261147; 2006/0016721; 2006/0016724; 2006/0076267; 2006/013210; 2006/0201851; 2006/020185, and 2006/0289337; U.S. Pat. Nos. 7,018,525 and 7,083,713 and U.S. application Ser. Nos. 11/400,570; 11/535,165 and 11/613,936, each of which are incorporated herein by reference. In general, the process involves a complete or partial hydroisomerization dewaxing step, employing a dual-functional catalyst or a catalyst that can isomerize paraffins selectively. Hydroisomerization dewaxing is achieved by contacting the waxy feed with a hydroisomerization catalyst in an isomerization zone under hydroisomerizing conditions.

Fischer-Tropsch synthesis products can be obtained by well-known processes such as, for example, the commercial SASOL® Slurry Phase Fischer-Tropsch technology, the commercial SHELL® Middle Distillate Synthesis (SMDS) Process, or by the non-commercial EXXON® Advanced Gas Conversion (AGC-21) process. Details of these processes and others are described in, for example, WO-A-9934917; WO-A-9920720; WO-A-05107935; EP-A-776959; EP-A-668342; U.S. Pat. Nos. 4,943,672, 5,059,299; 5,733,839; and RE39073; and U.S. Patent Application Publication No. 2005/0227866. The Fischer-Tropsch synthesis product can contain hydrocarbons having 1 to about 100 carbon atoms or, in some cases, more than 100 carbon atoms, and typically includes paraffins, olefins and oxygenated products.

A Group IV basestock, or polyalphaolefin (PAO) are typically made by the oligomerization of low molecular weight alpha-olefins, e.g., alpha-olefins containing at least 6 carbon atoms. In one embodiment, the alpha-olefins are alpha-olefins containing 10 carbon atoms. PAOs are mixtures of dimers, trimers, tetramers, etc., with the exact mixture depending upon the viscosity of the final basestock desired. PAOs are typically hydrogenated after oligomerization to remove any remaining unsaturation.

Group V base oils include all other base oils not included in Group I, II, III, or IV.

The marine diesel cylinder lubricating oil compositions of the present invention further comprise a detergent composition comprising (i) one or more alkaline earth metal salt of an alkyl-substituted hydroxyaromatic carboxylic acid having a TBN of about 100 to about 250, and (ii) one or more high overbased alkyl aromatic sulfonic acids or salts thereof; wherein the aromatic moiety of the alkyl aromatic sulfonic acids or salts thereof contains no hydroxyl groups.

In general, the one or more alkaline earth metal salts of an alkyl-substituted hydroxyaromatic carboxylic acid and the one or more high overbased alkyl aromatic sulfonic acids or salts thereof are provided as a concentrate in each of the additives are incorporated into a substantially inert, normally liquid organic diluent such as, for example, mineral oil, naphtha, benzene, toluene or xylene to form an additive concentrate. These concentrates usually contain from about 10% to about 90% by weight of such diluent or from about 20% to about 80% by weight of such diluent, with the remaining amount being the specific additive. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used.

The detergent composition employed in the marine diesel cylinder lubricating oil compositions of the present invention includes one or more alkaline earth metal salts of an alkyl-substituted hydroxyaromatic carboxylic acid having a TBN of about 100 to about 250. In one preferred embodiment, the one or more alkaline earth metal salts of an alkyl-substituted hydroxyaromatic carboxylic acid are one or more alkaline earth metal salts of an alkyl-substituted hydroxybenzoic acid having a TBN of about 100 to about 250. In one preferred embodiment, the one or more alkaline earth metal salts of an alkyl-substituted hydroxyaromatic carboxylic acid are calcium alkyl-substituted hydroxyaromatic carboxylic acids having a TBN of about 100 to about 250. In another preferred embodiment, the one or more alkaline earth metal salts of an alkyl-substituted hydroxyaromatic carboxylic acid has a major amount of one or more alkaline earth metal salts of mono-alkyl-substituted hydroxyaromatic carboxylic acid having a TBN of about 100 to about 250.

Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

The alkyl-substituted moiety of the alkaline earth metal salt of an alkyl-substituted hydroxyaromatic carboxylic acid can be derived from an alpha olefin having from about 10 to about 80 carbon atoms. In one embodiment, the alkyl-substituted moiety of the alkaline earth metal salt of an alkyl-substituted hydroxyaromatic carboxylic acid can be derived from an alpha olefin having from about 10 to about 40 carbon atoms. In one embodiment, the alkyl-substituted moiety of the alkaline earth metal salt of an alkyl-substituted hydroxyaromatic carboxylic acid can be derived from an alpha olefin having from about 12 to about 28 carbon atoms. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing.

In one embodiment, the mixture of linear olefins that may be used is a mixture of normal alpha olefins selected from olefins having from about 12 to about 28, or about 20 to 28, carbon atoms per molecule. In one embodiment, the normal alpha olefins are isomerized using at least one of a solid or liquid catalyst.

In another embodiment, the olefins include one or more olefins comprising $C_9$ to $C_{18}$ oligomers of monomers selected from propylene, butylene or mixtures thereof. Generally, the one or more olefins will contain a major mount of the $C_9$ to $C_{18}$ oligomers of monomers selected from propylene, butylene or mixtures thereof. Examples of such olefins include propylene tetramer, butylene trimer and the like. As one skilled in the art will readily appreciate, other olefins may be present. For example, the other olefins that can be used in addition to the $C_9$ to $C_{18}$ oligomers include linear olefins, cyclic olefins, branched olefins other than propylene oligomers such as butylene or isobutylene oligomers, arylalkylenes and the like and mixtures thereof. Suitable linear olefins include 1-hexene, 1-nonene, 1-decene, 1-dodecene and the like and mixtures thereof. Especially suitable linear olefins are high molecular weight normal alpha-olefins such as $C_{16}$ to $C_{30}$ normal alpha-olefins, which can be obtained from processes such as ethylene oligomerization or wax cracking. Suitable cyclic olefins include cyclohexene, cyclopentene, cyclooctene and the like and mixtures thereof. Suitable branched olefins include butylene dimer or trimer or higher molecular weight isobutylene oligomers, and the like and mixtures thereof. Suitable arylalkylenes include styrene, methyl styrene, 3-phenylpropene, 2-phenyl-2-butene and the like and mixtures thereof.

In one embodiment, the alkyl-substituted moiety of the alkaline earth metal salt of an alkyl-substituted hydroxyaromatic carboxylic acid can contain a mixture of $C_{12}$ alkyl groups and $C_{20}$ to $C_{28}$ linear olefins.

In one embodiment, the alkyl-substituted moiety of the alkaline earth metal salt of an alkyl-substituted hydroxyaromatic carboxylic acid can contain up to 50% by weight of $C_{20}$ to $C_{28}$ linear olefins in mixture with at least 50% by weight of a branched hydrocarbyl radical derived from propylene oligomer. In another embodiment, the alkyl-substituted moiety of the alkaline earth metal salt of an alkyl-substituted hydroxyaromatic carboxylic acid can contain up to 85% by weight of $C_{20}$ to $C_{28}$ linear olefins in mixture with at least 15% by weight of a branched hydrocarbyl radical derived from propylene oligomer.

In one embodiment, at least about 75 mole % (e.g., at least about 80 mole %, at least about 85 mole %, at least about 90 mole %, at least about 95 mole %, or at least about 99 mole %) of the alkyl groups contained within the alkaline earth metal salt of an alkyl-substituted hydroxyaromatic carboxylic acid are $C_{20}$ alkyl groups or higher. In another embodiment, the alkaline earth metal salt of an alkyl-substituted hydroxyaromatic carboxylic acid is an alkaline earth metal salt of an alkyl-substituted hydroxybenzoic acid that is derived from an alkyl-substituted hydroxybenzoic acid in which the alkyl groups are the residue of normal alpha-olefins containing at least 75 mole % $C_{20}$ or higher normal alpha-olefins.

In another embodiment, at least about 50 mole % (e.g., at least about 60 mole %, at least about 70 mole %, at least about 80 mole %, at least about 85 mole %, at least about 90 mole %, at least about 95 mole %, or at least about 99 mole %) of the alkyl groups contained within the alkaline earth metal salt of an alkyl-substituted hydroxyaromatic carboxylic acid are about $C_{14}$ to about $C_{18}$.

The resulting alkaline earth metal salt of an alkyl-substituted hydroxyaromatic carboxylic acid having a TBN of about 100 to about 250 can be a mixture of ortho and para isomers. In one embodiment, the product will contain about 1 to 99% ortho isomer and 99 to 1% para isomer. In another embodiment, the product will contain about 5 to 70% ortho and 95 to 30% para isomer.

The alkaline earth metal salts of an alkyl-substituted hydroxyaromatic carboxylic acid are one in which the BN of the alkaline earth metal salts of an alkyl-substituted hydroxyaromatic carboxylic acid has been increased by a process such as the addition of a base source (e.g., lime) and an acidic overbasing compound (e.g., carbon dioxide).

In other embodiments, the one or more alkaline earth metal salts of an alkyl-substituted hydroxyaromatic carboxylic acid having a TBN of about 100 to about 250 comprise a mixture of an alkyl-substituted hydroxybenzoic acid and an alkyl-substituted phenol. In another embodiment, the one or more alkaline earth metal salts of an alkyl-substituted hydroxyaromatic carboxylic acid having a TBN of about 100 to about 250 comprise an overbased salt of an alkyl-substituted hydroxybenzoic acid and/or an overbased salt of an alkyl-substituted phenol, in combination with a non-overbased salt of one or more of an alkyl-substituted hydroxybenzoic acid and an alkyl-substituted phenol.

In another embodiment, the one or more alkaline earth metal salts of an alkyl-substituted hydroxyaromatic carboxylic acid having a TBN of about 100 to about 250 comprise a carboxylate-containing detergent that comprises:

(a) a multi-surfactant unsulfurized, non-carbonated, non-overbased, carboxylate-containing additive prepared, for example, according to the method described in Example 1 of U.S. Patent Application Publication No. 2004/0235686, the contents of which are incorporated herein by reference in their entirety; and/or (b) an overbased calcium alkylhydroxybenzoate prepared, for example, according to the method described in Example 1 of U.S. Patent Application Publication No. 2007/0027043, the contents of which are incorporated herein by reference in their entirety.

Generally, the amount of the one or more alkaline earth metal salts of an alkyl-substituted hydroxyaromatic carboxylic acid having a TBN of about 100 to about 250 present in a marine diesel cylinder lubricating oil composition having a TBN of about 5 to about 120 can range from about 0.1 wt. % to about 35 wt. % on an actives basis, based on the total weight of the marine diesel cylinder lubricating oil composition. In one embodiment, the amount of the one or more alkaline earth metal salts of an alkyl-substituted hydroxyaromatic carboxylic acid having a TBN of about 100 to about 250 present in the marine diesel cylinder lubricating oil composition a marine diesel cylinder lubricating oil composition having a TBN of about 20 to about 100 can range from about 1 wt. % to about 25 wt. % on an actives basis, based on the total weight of the marine diesel cylinder lubricating oil composition. In one embodiment, the amount of the one or more alkaline earth metal salts of an alkyl-substituted hydroxyaromatic carboxylic acid having a TBN of about 100 to about 250 present in the marine diesel cylinder lubricating oil composition a also marine diesel cylinder lubricating oil composition having a TBN of about 20 to about 60 can range from about 3 wt. % to about 20 wt. % on an actives basis, based on the total weight of the marine diesel cylinder lubricating oil composition. In one embodiment, the amount of the one or more alkaline earth metal salts of an alkyl-substituted hydroxyaromatic carboxylic acid having a TBN of about 100 to about 250 present in the marine diesel cylinder lubricating oil composition a marine diesel cylinder lubricating oil composition having a TBN of about 30 to about 50 can range from about 5 wt. % to about 15 wt. % on an actives basis, based on the total weight of the marine diesel cylinder lubricating oil composition.

The detergent composition employed in the marine diesel cylinder lubricating oil compositions of the present invention also includes one or more high overbased alkyl aromatic sulfonic acids or salts thereof. The alkyl aromatic sulfonic acids or salts thereof include alkyl aromatic sulfonic acids or salts thereof obtained by the alkylation of an aromatic compound. The alkyl aromatic compound is then sulfonated to form an alkyl aromatic sulfonic acid. If desired, the alkyl aromatic sulfonic acid can be neutralized with caustic to obtain an alkali or alkaline earth metal alkyl aromatic sulfonate compound.

At least one aromatic compound or a mixture of aromatic compounds may be used to form the alkyl aromatic sulfonic acid or salt thereof. Suitable aromatic compounds or the aromatic compound mixture comprise at least one of monocyclic aromatics, such as benzene, toluene, xylene, cumene or mixtures thereof. In one preferred embodiment the at least one aromatic moiety of the alkyl aromatic sulfonic acids or salts contains no hydroxyl groups. In one preferred embodiment, the at least one aromatic moiety of the alkyl aromatic sulfonic acids or salts compound is not a phenol. In one embodiment, the at least one aromatic compound or aromatic compound mixture is toluene.

The at least one alkyl aromatic compound or the mixture of aromatic compounds is commercially available or may be prepared by methods that are well known in the art.

The alkylating agent employed to alkylate the aromatic compound may be derived from a variety of sources. Such sources include the normal alpha olefins, linear alpha olefins, isomerized linear alpha olefins, dimerized and oligomerized olefins, and olefins derived from olefin metathesis. The olefin may be a single carbon number olefin, or it may be a mixture of linear olefins, a mixture of isomerized linear olefins, a mixture of branched olefins, a mixture of partially branched olefins, or a mixture of any of the foregoing. Another source from which the olefins may be derived is through cracking of petroleum or Fischer-Tropsch wax. The Fischer-Tropsch wax may be hydrotreated prior to cracking. Other commercial sources include olefins derived from paraffin dehydrogenation and oligomerization of ethylene and other olefins, methanol-to-olefin processes (methanol cracker) and the like.

The olefins may selected from olefins with carbon numbers ranging from about 8 carbon atoms to about 60 carbon atoms. In one embodiment, the olefins are selected from olefins with carbon numbers ranging from about 10 to about 50 carbon atoms. In one embodiment, the olefins are selected from olefins with carbon numbers ranging from about 12 to about 40 carbon atoms.

In another embodiment, the olefin or the mixture of olefins is selected from linear alpha olefins or isomerized alpha olefins containing from about 8 to about 60 carbon atoms. In one embodiment, the mixture of olefins is selected from linear alpha olefins or isomerized alpha olefins containing from about 10 to about 50 carbon atoms. In one embodiment, the mixture of olefins is selected from linear alpha olefins or isomerized olefins containing from about 12 to about 40 carbon atoms.

The linear olefins that may be used for the alkylation reaction may be one or a mixture of normal alpha olefins selected from olefins having from about 8 to about 60 carbon atoms per molecule. In one embodiment, the normal alpha olefin is selected from olefins having from about 10 to about 50 carbon atoms per molecule. In one embodiment, the normal alpha olefin is selected from olefins having from about 12 to about 40 carbon atoms per molecule.

In one embodiment, the mixture of branched olefins is selected from polyolefins which may be derived from $C_3$ or higher monoolefins (e.g., propylene oligomers, butylenes oligomers, or co-oligomers etc.). In one embodiment, the mixture of branched olefins is either propylene oligomers or butylenes oligomers or mixtures thereof.

In one embodiment, the aromatic compound is alkylated with a mixture of normal alpha olefins containing from $C_8$ to $C_{60}$ carbon atoms. In one embodiment, the aromatic compound is alkylated with a mixture of normal alpha olefins containing from $C_{10}$ to $C_{50}$ carbon atoms. In another embodiment, the aromatic compound is alkylated with a mixture of normal alpha olefins containing from $C_{12}$ to $C_{40}$ carbon atoms to yield an aromatic alkylate.

The normal alpha olefins employed to make the alkylaromatic sulfonic acid or salt thereof are commercially available or may be prepared by methods that are well known in the art.

In one embodiment, the normal alpha olefins are isomerized using a solid or a liquid acid catalyst. A solid catalyst preferably has at least one metal oxide and an average pore size of less than 5.5 angstroms. In one embodiment, the solid catalyst is a molecular sieve with a one-dimensional pore system, such as SM-3, MAPO-11, SAPO-11, SSZ-32, ZSM-23, MAPO-39, SAPO-39, ZSM-22 or SSZ-20. Other possible acidic solid catalysts useful for isomerization include ZSM-35, SUZ-4, NU-23, NU-87 and natural or synthetic ferrierites. These molecular sieves are well known in the art and are discussed in Rosemarie Szostak's Handbook of Molecular Sieves (New York, Van Nostrand Reinhold, 1992) which is herein incorporated by reference for all purposes. A liquid type of isomerization catalyst that can be used is iron pentacarbonyl ($Fe(CO)_5$).

The process for isomerization of normal alpha olefins may be carried out in batch or continuous mode. The process temperatures may range from about 50° C. to about 250° C. In the batch mode, a typical method used is a stirred autoclave or glass flask, which may be heated to the desired reaction temperature. A continuous process is most efficiently carried out in a fixed bed process. Space rates in a fixed bed process can range from about 0.1 to about 10 or more weight hourly space velocity.

In a fixed bed process, the isomerization catalyst is charged to the reactor and activated or dried at a temperature of at least 125° C. under vacuum or flowing inert, dry gas. After activation, the temperature of the isomerization catalyst is adjusted to the desired reaction temperature and a flow of the olefin is introduced into the reactor. The reactor effluent containing the partially-branched, isomerized olefins is collected. The resulting partially-branched, isomerized olefins contain a different olefin distribution (i.e., alpha olefin, beta olefin; internal olefin, tri-substituted olefin, and vinylidene olefin) and branching content than that of the unisomerized olefin and conditions are selected in order to obtain the desired olefin distribution and the degree of branching.

Typically, the alkylated aromatic compound may be prepared using a Bronsted acid catalyst, a Lewis acid catalyst, or solid acidic catalysts.

The Bronsted acid catalyst may be selected from a group comprising hydrochloric acid, hydrofluoric acid, hydrobromic acid, sulfuric acid, perchloric acid, trifluoromethane sulfonic acid, fluorosulfonic acid, and nitric acid and the like. In one embodiment, the Bronsted acid catalyst is hydrofluoric acid.

The Lewis acid catalyst may be selected from the group of Lewis acids comprising aluminum trichloride, aluminum tribromide, aluminum triiodide, boron trifluoride, boron tribromide, boron triiodide and the like. In one embodiment, the Lewis acid catalyst is aluminum trichloride.

The solid acidic catalysts may be selected from a group comprising zeolites, acid clays, and/or silica-alumina. An eligible solid catalyst is a cation exchange resin in its acid form, for example, crosslinked sulfonic acid catalyst. The catalyst may be a molecular sieve. Suitable molecular sieves are silica-aluminophosphate molecular sieves or metal silica-aluminophosphate molecular sieves, in which the metal may be, for example, iron, cobalt or nickel. Other suitable examples of solid acidic catalysts are disclosed in U.S. Pat. No. 7,183,452, the contents of which are incorporated by reference herein.

The Bronsted acid catalyst may be regenerated after it becomes deactivated (i.e., the catalyst has lost all or some portion of its catalytic activity). Methods that are well known in the art may be used to regenerate the acid catalyst, for example, hydrofluoric acid.

The alkylation technologies used to produce the alkyl aromatic will include Bronsted and/or Lewis acids as well as solid acid catalysts utilized in a batch, semi-batch or continuous process operating at between from about 0 to about 300° C.

The acid catalyst may be recycled when used in a continuous process. The acid catalyst may be recycled or regenerated when used in a batch process or a continuous process.

In one embodiment, the alkylation process is carried out by reacting a first amount of at least one aromatic compound or a mixture of aromatic compounds with a first amount of a mixture of olefin compounds in the presence of a Bronsted acid catalyst, such as hydrofluoric acid, in a first reactor in which agitation is maintained, thereby producing a first reaction mixture. The resulting first reaction mixture is held in a first alkylation zone under alkylation conditions for a time sufficient to convert the olefin to aromatic alkylate (i.e., a first reaction product). After a desired time, the first reaction product is removed from the alkylation zone and fed to a second reactor wherein the first reaction product is reacted with an additional amount of at least one aromatic compound or a mixture of aromatic compounds and an additional amount of acid catalyst and, optionally, with an additional amount of a mixture of olefin compounds wherein agitation is maintained. A second reaction mixture results and is held in a second alkylation zone under alkylation conditions for a time sufficient to convert the olefin to aromatic alkylate (i.e., a second reaction product). The second reaction product is fed to a liquid-liquid separator to allow hydrocarbon (i.e., organic) products to separate from the acid catalyst. The acid catalyst may be recycled to the reactor(s) in a closed loop cycle. The hydrocarbon product is further treated to remove excess un-reacted aromatic compounds and, optionally, olefinic compounds from the desired alkylate product. The excess aromatic compounds may also be recycled to the reactor(s).

In another embodiment, the reaction takes place in more than two reactors which are located in series. Instead of feeding the second reaction product to a liquid-liquid separator, the second reaction product is fed to a third reactor wherein the second reaction product is reacted with an additional amount of at least one aromatic compound or a mixture of aromatic compounds and an additional amount of acid catalyst and, optionally, with an additional amount of a mixture of olefin compounds wherein agitation is maintained. A third reaction mixture results and is held in a third alkylation zone under alkylation conditions for a time sufficient to convert the olefin to aromatic alkylate (i.e., a third reaction product). The reactions take place in as many reactors as necessary to obtain the desired alkylated aromatic reaction product.

The total charge mole ratio of Bronsted acid catalyst to the olefin compounds is about 0.1 to about 1 for the combined reactors. In one embodiment, the charge mole ratio of Bronsted acid catalyst to the olefin compounds is no more than about 0.7 to about 1 in the first reactor and no less than about 0.3 to about 1 in the second reactor.

The total charge mole ratio of the aromatic compound to the olefin compounds is about 7.5:1 to about 1:1 for the combined reactors. In one embodiment, the charge mole ratio of the aromatic compound to the olefin compounds is no less than about 1.4:1 to about 1:1 in the first reactor and is no more than about 6.1:1 to about 1:1 in the second reactor.

Many types of reactor configurations may be used for the reactor zone. These include, but are not limited to, batch and continuous stirred tank reactors, reactor riser configurations, ebulating bed reactors, and other reactor configurations that are well known in the art. Many such reactors are known to those skilled in the art and are suitable for the alkylation reaction. Agitation is critical for the alkylation reaction and can be provided by rotating impellers, with or without baffles, static mixers, kinetic mixing in risers, or any other agitation devices that are well known in the art. The alkylation process may be carried out at temperatures from about 0° C. to about 100° C. The process is carried out under sufficient pressure that a substantial portion of the feed components remain in the liquid phase. Typically, a pressure of 0 to 150 psig is satisfactory to maintain feed and products in the liquid phase.

The residence time in the reactor is a time that is sufficient to convert a substantial portion of the olefin to alkylate product. The time required is from about 30 seconds to about 30 minutes. A more precise residence time may be determined by those skilled in the art using batch stirred tank reactors to measure the kinetics of the alkylation process.

The at least one aromatic compound or mixture of aromatic compounds and the olefin compounds may be injected separately into the reaction zone or may be mixed prior to injection. Both single and multiple reaction zones may be used with the injection of the aromatic compounds and the olefin compounds into one, several, or all reaction zones. The reaction zones need not be maintained at the same process conditions. The hydrocarbon feed for the alkylation process may comprise a mixture of aromatic compounds and olefin compounds in which the molar ratio of aromatic compounds to olefins is from about 0.5:1 to about 50:1 or more. In the case where the molar ratio of aromatic compounds to olefin is >1.0 to 1, there is an excess amount of aromatic compounds present. In one embodiment, an excess of aromatic compounds is used to increase reaction rate and improve product selectivity. When excess aromatic compounds are used, the excess un-reacted aromatic in the reactor effluent can be separated, e.g., by distillation, and recycled to the reactor.

Once the alkyl aromatic product is obtained as described above, it is further reacted to form an alkyl aromatic sulfonic acid, and can then be neutralized to the corresponding sulfonate. Sulfonation of the alkyl aromatic compound may be performed by any method known to one of ordinary skill in the art. The sulfonation reaction is typically carried out in a continuous falling film tubular reactor maintained at about 45° C. to about 75° C. For example, the alkyl aromatic compound is placed in the reactor along with sulfur trioxide diluted with air thereby producing an alkylaryl sulfonic acid. Other sulfonation reagents, such as sulfuric acid, chlorosulfonic acid or sulfamic acid may also be employed. In one embodiment, the alkyl aromatic compound is sulfonated with sulfur trioxide diluted with air. The charge mole ratio of sulfur trioxide to alkylate is maintained at about 0.8 to about 1.1:1.

If desired, neutralization of the alkyl aromatic sulfonic acid may be carried out in a continuous or batch process by any method known to a person skilled in the art to produce alkyl aromatic sulfonates. Typically, an alkyl aromatic sulfonic acid is neutralized with a source of alkali or alkaline earth metal or ammonia, thereby producing an alkyl aromatic sulfonate. Non-limiting examples of suitable alkali metals include lithium, sodium, potassium, rubidium, and cesium. In one embodiment, a suitable alkali metal includes sodium and potassium. In another embodiment, a suitable alkali metal is sodium. Non-limiting examples of suitable alkaline earth metals include calcium, barium, magnesium, or strontium and the like. In one embodiment, a suitable alkaline earth metal is calcium. In one embodiment, the source is an alkali metal base such as an alkali metal hydroxide, e.g., sodium hydroxide or potassium hydroxide. In one embodiment, the source is an alkaline earth metal base such as an alkaline earth metal hydroxide, e.g., calcium hydroxide.

The one or more alkyl aromatic sulfonic acid or salts thereof are one or more high overbased alkyl aromatic sulfonic acid or salts thereof. As discussed above, overbasing is one in which the TBN of the alkyl aromatic sulfonic acid or salts thereof has been increased by a process such as, for example, the addition of a base source (e.g., lime) and an acidic overbasing compound (e.g., carbon dioxide). Methods for overbasing are well known in the art. The one or more high overbased alkyl aromatic sulfonic acids or salts thereof will have a TBN greater than 250. In one embodiment, the one or more high overbased alkyl aromatic sulfonic acids or salts thereof will have a TBN of about 250 to about 550. In one embodiment, the one or more high overbased alkyl aromatic sulfonic acids or salts thereof will have a TBN of about 250 to about 500.

Generally, the amount of the one or more high overbased alkyl aromatic sulfonic acids or salts thereof present in a marine diesel cylinder lubricating oil composition having a TBN of about 5 to about 120 can range from about 0.1 wt. % to about 34 wt. % on an actives basis, based on the total weight of the marine diesel cylinder lubricating oil composition. In one embodiment, the amount of the one or more high overbased alkyl aromatic sulfonic acids or salts thereof present in a marine diesel cylinder lubricating oil composition having a TBN of about 20 to about 100 can range from about 1 wt. % to about 30 wt. % on an actives basis, based on the total weight of the marine diesel cylinder lubricating oil composition. In one embodiment, the amount of the one or more high overbased alkyl aromatic sulfonic acids or salts thereof present in a marine diesel cylinder lubricating oil composition having a TBN of about 20 to about 60 can range from about 2 wt. % to about 24 wt. % on an actives basis, based on the total weight of the marine diesel cylinder lubricating oil composition. In one embodiment, the amount of the one or more high overbased alkyl aromatic sulfonic acids or salts thereof present in a marine diesel cylinder lubricating oil composition having a TBN of about 30 to about 50 can range from about 5 wt. % to about 16 wt. % on an actives basis, based on the total weight of the marine diesel cylinder lubricating oil composition.

The marine diesel cylinder lubricating oil compositions of the present invention may also contain conventional marine diesel cylinder lubricating oil composition additives, other than the foregoing one or more alkaline earth metal salts of an alkyl-substituted hydroxyaromatic carboxylic acid having a TBN of about 100 to about 250 and the one or more high overbased alkyl aromatic sulfonic acids or salts thereof, for imparting auxiliary functions to give a marine diesel cylinder lubricating oil composition in which these additives are dispersed or dissolved. For example, the marine diesel cylinder lubricating oil compositions can be blended with antioxidants, ashless dispersants, other detergents, anti-wear agents, rust inhibitors, dehazing agents, demulsifying agents, metal deactivating agents, friction modifiers, pour point depressants, antifoaming agents, co-solvents, package compatibilisers, corrosion-inhibitors, dyes, extreme pressure agents and the like and mixtures thereof. A variety of the additives are known and commercially available. These additives, or their analogous compounds, can be employed for the preparation of the marine diesel cylinder lubricating oil compositions of the invention by the usual blending procedures.

In one embodiment, the marine diesel cylinder lubricating oil compositions of the present invention contain essentially no thickener (i.e., a viscosity index improver).

Examples of antioxidants include, but are not limited to, aminic types, e.g., diphenylamine, phenyl-alpha-napthylamine, N,N-di(alkylphenyl) amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof.

The ashless dispersant compounds employed in the marine diesel cylinder lubricating oil compositions of the present invention are generally used to maintain in suspension insoluble materials resulting from oxidation during use, thus preventing sludge flocculation and precipitation or deposition on metal parts. Dispersants may also function to reduce changes in lubricating oil viscosity by preventing the growth of large contaminant particles in the lubricant. The dispersant employed in the present invention may be any suitable ashless dispersant or mixture of multiple ashless dispersants for use in a marine diesel cylinder lubricating oil composition. An ashless dispersant generally comprises an oil soluble polymeric hydrocarbon backbone having functional groups that are capable of associating with particles to be dispersed.

In one embodiment, an ashless dispersant is one or more basic nitrogen-containing ashless dispersants. Nitrogen-containing basic ashless (metal-free) dispersants contribute to the base number or BN (as can be measured by ASTM D 2896) of a lubricating oil composition to which they are added, without introducing additional sulfated ash. Basic nitrogen-containing ashless dispersants useful in this invention include hydrocarbyl succinimides; hydrocarbyl succinamides; mixed ester/amides of hydrocarbyl-substituted succinic acids formed by reacting a hydrocarbyl-substituted succinic acylating agent stepwise or with a mixture of alcohols and amines, and/or with amino alcohols; Mannich condensation products of hydrocarbyl-substituted phenols, formaldehyde and polyamines; and amine dispersants formed by reacting high molecular weight aliphatic or alicyclic halides with amines, such as polyalkylene polyamines. Mixtures of such dispersants can also be used.

Representative examples of ashless dispersants include, but are not limited to, amines, alcohols, amides, or ester polar moieties attached to the polymer backbones via bridging groups. An ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersant. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants may be represented by the formula:

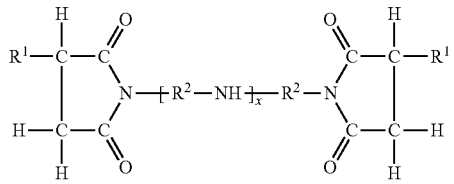

wherein each $R^1$ is independently a hydrocarbyl group, such as a polyolefin-derived group. Typically the hydrocarbyl group is an alkyl group, such as a polyisobutyl group. Alternatively expressed, the $R^1$ groups can contain about 40 to about 500 carbon atoms, and these atoms may be present in aliphatic forms. $R^2$ is an alkylene group, commonly an ethylene ($C_2H_4$) group. Examples of succinimide dispersants include those described in, for example, U.S. Pat. Nos. 3,172,892, 4,234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contain nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629, 3,591,598 and 3,980,569.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2400, and most preferably from about 2000 to about 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

In one preferred embodiment of the present invention, an ashless dispersant for use in the marine diesel cylinder lubricating oil composition is a bis-succinimide derived from a polyisobutenyl group having a number average molecular weight of about 700 to about 2300. The dispersant (s) for use in the lubricating oil compositions of the present invention are preferably non-polymeric (e g., are mono- or bis-succinimides).

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to about 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g., carbonate) micelle. Such overbased detergents may have a TBN of about 50 or greater, or a TBN of about 100 or greater, or a TBN of about 200 or greater, or a TBN of from about 250 to about 450 or more.

Representative examples of other metal detergents that can be included in the marine diesel cylinder lubricating oil composition of the present invention include phenates, aliphatic sulfonates, phosphonates, and phosphinates. Commercial products are generally referred to as neutral or overbased. Overbased metal detergents are generally produced by carbonating a mixture of hydrocarbons, detergent acid, for example: sulfonic acid, carboxylate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

Overbased detergents may be low overbased, e.g., an overbased salt having a BN below about 100. In one embodiment, the BN of a low overbased salt may be from about 5 to about 50. In another embodiment, the BN of a low overbased salt may be from about 10 to about 30. In yet another embodiment, the BN of a low overbased salt may be from about 15 to about 20.

Overbased detergents may be medium overbased, e.g., an overbased salt having a BN from about 100 to about 250. In one embodiment, the BN of a medium overbased salt may be from about 100 to about 200. In another embodiment, the BN of a medium overbased salt may be from about 125 to about 175.

Overbased detergents may be high overbased, e.g., an overbased salt having a BN above 250. In one embodiment, the BN of a high overbased salt may be from about 250 to about 550.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine, e.g., a mono- or dialkanolamine, and the like and mixtures thereof.

Examples of antiwear agents include, but are not limited to, zinc dialkyldithiophosphates and zinc diaryldithiophosphates, e.g., those described in an article by Born et al. entitled "Relationship between Chemical Structure and Effectiveness of Some Metallic Dialkyl- and Diaryl-dithiophosphates in Different Lubricated Mechanisms", appearing in Lubrication Science 4-2 Jan. 1992, see for example pages 97-100; aryl phosphates and phosphites, sulfur-containing esters, phosphosulfur compounds, metal or ash-free dithiocarbamates, xanthates, alkyl sulfides and the like and mixtures thereof.

Examples of antifoaming agents include, but are not limited to, polymers of alkyl methacrylate; polymers of dimethylsilicone and the like and mixtures thereof.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In one embodiment, a pour point depressant comprises an ethylene-vinyl acetate copolymer, a condensate of chlorinated paraffin and phenol, polyalkyl styrene and the like and combinations thereof. The amount of the pour point depressant may vary from about 0.01 wt. % to about 10 wt. %.

Examples of a demulsifier include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof. The amount of the demulsifier may vary from about 0.01 wt. % to about 10 wt. %.

Examples of a corrosion inhibitor include, but are not limited to, half esters or amides of dodecylsuccinic acid, phosphate esters, thiophosphates, alkyl imidazolines, sarcosines and the like and combinations thereof. The amount of the corrosion inhibitor may vary from about 0.01 wt. % to about 0.5 wt. %.

Examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof. The amount of the extreme pressure agent may vary from about 0.01 wt. % to about 5 wt. %.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the lubricating oil composition.

In addition, the foregoing marine diesel cylinder lubricating oil composition additives may be provided as an additive package or concentrate in which the additives are incorporated into a substantially inert, normally liquid organic diluent as described above. The additive package will typically contain one or more of the various additives, referred to above, in the desired amounts and ratios to facilitate direct combination with the requisite amount of the oil of lubricating viscosity.

In one embodiment, the marine diesel cylinder lubricating oil composition of the present invention is substantially free of an unsulfurized tetrapropenyl phenol compound and its unsulfurized metal salt, e.g., TPP and its calcium salt. The term "substantially free" as used herein means relatively low levels, if any, of the unsulfurized tetrapropenyl phenol and its unsulfurized metal salt, e.g., less than about 1.5 wt. % in the marine diesel cylinder lubricating oil composition. In another embodiment, the term "substantially free" is less than about 1 wt. % in the marine diesel cylinder lubricating oil composition. In another embodiment, the term "substantially free" is less than about 0.3 wt. %. In another embodiment, the term "substantially free" is less than about 0.1 wt. %. In another embodiment, the term "substantially free" is from about 0.0001 to about 0.3 wt. %.

In one embodiment, the marine diesel cylinder lubricating oil composition of the present invention is substantially free or free of any dispersants and/or zinc compounds, e.g., zinc dithiophosphates. The term "substantially free" as used herein means relatively low levels, if any, of each of the dispersants and/or zinc compounds, e.g., less than about 0.5 wt. % of each of the dispersants and/or zinc compounds in the marine diesel cylinder lubricating oil composition. In another embodiment, the term "substantially free" is less than about 0.1 wt. % of each of the dispersants and/or zinc compounds in the marine diesel cylinder lubricating oil composition. In another embodiment, the term "substantially free" is less than about 0.01 wt. % of each of the dispersants and/or zinc compounds in the marine diesel cylinder lubricating oil composition.

The following non-limiting examples are illustrative of the present invention.

The degree of high temperature detergency and thermal stability marine lubricants was evaluated for each of the following examples using the Komatsu Hot Tube ("KHT") test as described below. The results for each of the examples are set forth in Table 1.

Komatsu Hot Tube (KHT) Test

The Komatsu Hot Tube test is a lubrication industry bench test that measures the detergency and thermal and oxidative stability of a lubricating oil. Detergency and thermal and oxidative stability are performance areas that are generally accepted in the industry as being essential to satisfactory overall performance of a lubricating oil. During the test, a specified amount of test oil is pumped upwards through a glass tube that is placed inside an oven set at a certain temperature. Air is introduced in the oil stream before the oil enters the glass tube, and flows upward with the oil. Evaluations of the marine cylinder lubricating oils were conducted at temperatures between 300 to 330° C. The test result is determined by comparing the amount of lacquer deposited on the glass test tube to a rating scale ranging from 1.0 (very black) to 10.0 (perfectly clean). The result is reported in multiples of 0.5. In the case the glass tubes are completely blocked with deposits, the test result is recorded as "blocked". Blockage is deposition below a 1.0 result, in which case the lacquer is very thick and dark but still allows fluid flow, although at a rate that is completely unsatisfactory for a usable oil.

The following components are used below in formulating a marine diesel engine lubricating oil composition of the examples.

Chevron 600R: Group II-based lubricating oil was Chevron 600R basestock, available from Chevron Products Company (San Ramon, Calif.).

ExxonMobil CORE® 150N: Group I-based lubricating oil was ExxonMobil CORE® 150N basestock, available from ExxonMobil (Irving, Tex.).

ExxonMobil CORE™ 2500BS: Group I-based lubricating oil was ExxonMobil CORE® 2500BS basestock, available from ExxonMobil (Irving, Tex.).

The detergents used in the examples in Table 1 are described below.

Detergent A: An oil concentrate of a neutral (non-overbased) calcium alkylhydroxybenzoate additive, having an alkyl substituent derived from $C_{20}$ to $C_{28}$ linear olefins, prepared according to the method described in Example 1 of US Patent Application 2007/0027043, but without the subsequent overbasing step. This additive concentrate contained 2.17 wt. % Ca and about 43.0 wt. % diluent oil, and had a TBN of 61. On an active basis, the TBN of this additive (absent diluent oil) is 107.

Detergent B: An oil concentrate of an overbased sulfurized calcium phenate derived from propylene tetramer. This additive contained 9.6 wt. % Ca, and about 31.4 wt. % diluent oil, and had a TBN of 260.

Detergent C: An oil concentrate of an unsulfurized, non-overbased alkylhydroxybenzoate-containing, phenol-distilled additive, having an alkyl substituent derived from about 50 wt. % $C_{20}$ to $C_{28}$ linear olefins and 50 wt. % branched hydrocarbyl radical propylene tetramer, prepared according to the method described in Example 1 of US Patent Application 2004/0235686. This additive contained 5.00 wt. % Ca, and about 33.0 wt. % diluent oil, and had a TBN of 140. On an active basis, the TBN of this additive (absent diluent oil) is 210.

Detergent D: An oil concentrate of an overbased calcium alkylhydroxybenzoate additive, having an alkyl substituent derived from $C_{20}$ to $C_{28}$ linear olefins, prepared according to the method described in Example 1 of US Patent Application 2007/0027043. This additive contained 5.35 wt. % Ca, and about 35.0 wt. % diluent oil, and had a TBN of 150. On an active basis, the TBN of this additive (absent diluent oil) is 230.

Detergent E: An oil concentrate of an overbased calcium alkylhydroxybenzoate additive, having an alkyl substituent derived from $C_{20}$ to $C_{28}$ linear olefins, prepared according to the method described in Example 1 of US Patent Application 2007/0027043. This additive contained 12.5 wt. % Ca, and about 33.0 wt. % diluent oil, and had a TBN of 350. On an active basis, the TBN of this additive (absent diluent oil) is 522.

Detergent F: An oil concentrate of an overbased calcium alkyltoluene sulfonate detergent; wherein the alkyl group is derived from $C_{20}$ to $C_{24}$ linear alpha olefins. This additive concentrate contained 16.1 wt. % Ca, and about 38.7 wt. % diluent oil, and had a TBN of 420. On an active basis, the TBN of this additive (absent diluent oil) is 685.

EXAMPLES 1-3 AND COMPARATIVE EXAMPLES A-J

The marine diesel engine lubricating oil compositions of Examples 1-3 and Comparative Examples A-J were prepared as set forth below in Table 1. Each marine diesel engine lubricating oil composition was an SAE 40 viscosity grade, and having a kinematic viscosity of 14.5 cSt @100 C and a TBN of 40 mg KOH/g. The marine diesel engine lubricating oil compositions of Examples 1-3 and Comparative Examples A-J were formulated using a major amount of Group II basestock and a minor amount of a Group I basestock, a detergent composition as defined in Table 1, and 0.04 wt. % foam inhibitor. Comparative Example D further comprised 0.57 wt. % of an oil concentrate of a bissuccinimide dispersant derived from 1000 MW polyisobutylene succinic anhydride (PIBSA) and heavy polyamine (HPA)/diethylene triamine (DETA), having about 31.7 wt. % diluent oil.

TABLE 1

| | Examples | | | | | | | | | | | | |
|---|---|---|---|---|---|---|---|---|---|---|---|---|---|
| | 1 | 2 | 3 | A | B | C | D | E | F | G | H | I | J |
| Components | | | | | | | | | | | | | |
| Chevron 600 RLOP, wt % | 83.60 | 80.02 | 80.18 | 84.34 | 80.82 | 78.33 | 84.03 | 82.71 | 78.16 | 78.0 | 72.23 | 81.16 | 72.69 |
| Esso 150 Neutral, wt % | 2.23 | — | — | — | — | — | — | 1.78 | — | — | 8.95 | 0.95 | 5.18 |
| Esso Core 2500 bright stock, wt % | — | 6.74 | 3.12 | — | 9.72 | 10.43 | 2.81 | — | 7.26 | 3.74 | — | — | — |
| Detergent A, wt % | — | — | 8.42 | — | — | — | — | — | — | 8.42 | — | — | 8.42 |
| Detergent B, wt % | — | — | — | 15.62 | — | — | 7.81 | — | — | — | 11.71 | 11.71 | 13.67 |
| Detergent C, wt % | 7.07 | — | — | — | — | — | — | 7.07 | — | — | 7.07 | — | — |
| Detergent D, wt % | — | 6.14 | — | — | — | — | — | — | 6.14 | — | — | 6.14 | — |
| Detergent E, wt % | — | — | — | — | — | 11.20 | — | 8.40 | 8.40 | 9.80 | — | — | — |
| Detergent F, wt % | 7.06 | 7.06 | 8.24 | — | 9.42 | | 4.71 | — | — | | — | — | — |
| Foam Inhibitor | 0.04 | 0.04 | 0.04 | 0.04 | 0.04 | 0.04 | 0.04 | 0.04 | 0.04 | 0.04 | 0.04 | 0.04 | 0.04 |
| Test Result | | | | | | | | | | | | | |
| KHT @ 300 C. Rating | 9.0 | 9.5 | 9.5 | 7.5 | 9.0 | 4.0 | 8.5 | 8.0 | 6.5 | 7.0 | 9.0 | 8.0 | 7.5 |
| KHT @ 310 C. Rating | 9.0 | 8.5 | 9.0 | 5.0 | 2.5 | 5.5 | 6.5 | 4.5 | 4.5 | 5.5 | 6.0 | 5.5 | 6.5 |
| KHT @ 315 C. Rating | 8.5 | 8.0 | 8.5 | 4.5 | blocked | blocked | blocked | 4.0 | 4.0 | 4.5 | 6.0 | 4.5 | 5.5 |
| KHT @ 320 C. Rating | blocked | blocked | blocked | 4.0 | NA | blocked | blocked | blocked | blocked | blocked | 4.5 | blocked | blocked |
| KHT @ 325 C. Rating | NA | NA | NA | blocked | NA | NA | NA | NA | NA | NA | 4.5 | NA | NA |
| KHT @ 330 C. Rating | NA | NA | NA | NA | NA | NA | NA | NA | NA | NA | blocked | NA | NA |

As the results set forth in Table 1 show, the marine diesel lubricating oil compositions of Examples 1-3 exhibited surprisingly superior detergency properties over the marine diesel lubricating oil compositions of Comparative Examples A-J. This is illustrated by higher KHT values which were sustained over higher temperature ranges, indicating that the marine diesel lubricating oil compositions of Examples 1-3 exhibit excellent detergency and thermal stability in the hot tube test in that they produce little lubricating oil oxidation or degradation product to defile the tube.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A marine diesel cylinder lubricating oil composition which comprises:

(a) a major amount of one or more Group II basestocks, and (b) a detergent composition comprising:

(i) about 5 to about 15 wt. % on an actives basis, based on the total weight of the marine diesel cylinder lubricating oil composition, of one or more alkaline earth metal salts of an alkyl-substituted hydroxyaromatic carboxylic acid having a total base number (TBN) of about 100 to about 250, wherein the alkyl-substituted moiety of the alkaline earth metal salt of an alkyl-substituted hydroxyaromatic carboxylic acid is a $C_{12}$ to $C_{28}$ alkyl group; and (ii) about 5 to about 16 wt. % an actives basis, based on the total weight of the marine diesel cylinder lubricating oil composition, of one or more high overbased calcium alkyl toluene sulfonic acids or salts thereof having a TBN of greater than 250 to about 550; wherein the toluene moiety of the calcium alkyl toluene sulfonic acids or salts thereof contains no hydroxyl groups, and further wherein the alkyl moiety of the calcium alkyl toluene sulfonic acids or salts thereof is a $C_{12}$ to $C_{40}$ alkyl group; and wherein the marine diesel cylinder lubricating oil composition has a TBN of about 30 to about 50.

2. The marine diesel cylinder lubricating oil composition of claim 1, wherein the one or more alkaline earth metal salts of an alkyl-substituted hydroxyaromatic carboxylic acid are one or more calcium salts of an alkyl-substituted hydroxyaromatic carboxylic acid.

3. The marine diesel cylinder lubricating oil composition of claim 1, wherein the one or more alkaline earth metal salts of an alkyl-substituted hydroxyaromatic carboxylic acid are one or more calcium salts of an alkyl-substituted hydroxybenzoic carboxylic acid.

4. The marine diesel cylinder lubricating oil composition of claim 1, wherein the alkyl-substituted moiety of the alkaline earth metal salt of an alkyl-substituted hydroxyaromatic carboxylic acid is a $C_{20}$ to $C_{28}$ alkyl group.

5. The marine diesel cylinder lubricating oil composition of claim 1, further comprising one or more marine diesel cylinder lubricating oil composition additives selected from the group consisting of an antioxidant, ashless dispersant, detergent, rust inhibitor, dehazing agent, demulsifying agent, metal deactivating agent, friction modifier, pour point depressant, antifoaming agent, co-solvent, package compatibiliser, corrosion-inhibitor, dyes, extreme pressure agent and mixtures thereof.

6. The marine diesel cylinder lubricating oil composition of claim 1, which is substantially free of an unsulfurized tetrapropenyl phenol and its unsulfurized metal salt.

7. The marine diesel cylinder lubricating oil composition of claim 1, which is substantially free of any dispersants and/or zinc compounds.

8. A method for lubricating a marine two-stroke crosshead diesel engine with a marine diesel cylinder lubricant composition having improved high temperature detergency; wherein the method comprises operating the engine with a marine diesel cylinder lubricating oil composition comprising:

(a) a major amount of one or more Group II basestocks, and (b) a detergent composition comprising:

(i) about 5 to about 15 wt. % on an actives basis, based on the total weight of the marine diesel cylinder lubricating oil composition, of one or more alkaline earth metal salts of an alkyl-substituted hydroxyaromatic carboxylic acid having a total base number (TBN) of about 100 to about 250, wherein the alkyl-substituted moiety of the alkaline earth metal salt of an alkyl-substituted hydroxyaromatic carboxylic acid is a $C_{12}$ to $C_{28}$ alkyl group; and (ii) about 5 to about 16 wt. % on an actives basis, based on the total weight of the marine diesel cylinder lubricating oil composition, of one or more high overbased calcium alkyl toluene sulfonic acids or salts thereof having a TBN of greater than 250 to about 550; wherein the toluene moiety of the calcium alkyl toluene sulfonic acids or salts thereof contains no hydroxyl groups, and further wherein the alkyl moiety of the calcium alkyl toluene sulfonic acids or salts thereof is a $C_{12}$ to $C_{40}$ alkyl group; and wherein the marine diesel cylinder lubricating oil composition has a TBN of about 30 to about 50.

9. The method of claim 8, wherein the marine diesel cylinder lubricating oil composition further comprises a marine diesel cylinder lubricating oil composition additive selected from the group consisting of an antioxidant, ashless dispersant, detergent, rust inhibitor, dehazing agent, demulsifying agent, metal deactivating agent, friction modifier, pour point depressant, antifoaming agent, co-solvent, package compatibilizer, corrosion-inhibitor, dyes, extreme pressure agent and mixtures thereof.

10. The method of claim 8, wherein the marine diesel cylinder lubricating oil composition has a kinematic viscosity ranging from about 12.5 to about 26.1 centistokes (cSt) at 100° C.

11. A marine diesel cylinder lubricating oil composition comprising:

(a) a major amount of one or more Group II basestocks, and (b) a detergent composition comprising:

(i) about 5 to about 15 wt. % on an actives basis, based on the total weight of the marine diesel cylinder lubricating oil composition, of one or more alkaline earth metal salts of an alkyl-substituted hydroxyaromatic carboxylic acid having a total base number (TBN) of about 100 to about 250, wherein the alkyl-substituted moiety of the alkaline earth metal salt of an alkyl-substituted hydroxyaromatic carboxylic acid is a $C_{12}$ to $C_{28}$ alkyl group; and (ii) about 5 to about 16 wt. % on an actives basis, based on the total weight of the marine diesel cylinder lubricating oil composition, of one or more high overbased calcium alkyl toluene sulfonic acids or salts thereof having a TBN of greater than 250 to about 550; wherein the toluene moiety of the calcium alkyl toluene sulfonic acids or salts thereof contains no hydroxyl groups, and further wherein the alkyl moiety of the calcium alkyl toluene sulfonic acids or salts thereof is a $C_{12}$ to $C_{40}$ alkyl group; and wherein the marine diesel cylinder lubricating oil composition has a TBN of about 30 to about 50 and a kinematic viscosity ranging from about 12.5 to about 26.1 centistokes (cSt) at 100° C.

12. The marine diesel cylinder lubricating oil composition of claim 11, wherein the one or more alkaline earth metal salts of an alkyl-substituted hydroxyaromatic carboxylic acid are one or more calcium salts of an alkyl-substituted hydroxyaromatic carboxylic acid.

13. The marine diesel cylinder lubricating oil composition of claim 11, wherein the alkyl-substituted moiety of the alkaline earth metal salt of an alkyl-substituted hydroxyaromatic carboxylic acid is a $C_{20}$ to $C_{28}$ alkyl group.

14. The marine diesel cylinder lubricating oil composition of claim 11, further comprising one or more marine diesel cylinder lubricating oil composition additives selected from the group consisting of an antioxidant, ashless dispersant, detergent, rust inhibitor, dehazing agent, demulsifying agent, metal deactivating agent, friction modifier, pour point depressant, antifoaming agent, co-solvent, package compatibiliser, corrosion-inhibitor, dyes, extreme pressure agent and mixtures thereof.

15. The marine diesel cylinder lubricating oil composition of claim 11, which is substantially free of an unsulfurized tetrapropenyl phenol and its unsulfurized metal salt.

16. The marine diesel cylinder lubricating oil composition of claim 11, which is substantially free of any dispersants and/or zinc compounds.

17. The method of claim 8, wherein the one or more alkaline earth metal salts of an alkyl-substituted hydroxyaromatic carboxylic acid are one or more calcium salts of an alkyl-substituted hydroxyaromatic carboxylic acid.

18. The method of claim 8, wherein the alkyl-substituted moiety of the alkaline earth metal salt of an alkyl-substituted hydroxyaromatic carboxylic acid is a $C_{20}$ to $C_{28}$ alkyl group.

19. The method of claim 8, which is substantially free of an unsulfurized tetrapropenyl phenol and its unsulfurized metal salt.

20. The method of claim 8, which is substantially free of any dispersants and/or zinc compounds.

* * * * *